US011859827B1

(12) United States Patent
Redlinski

(10) Patent No.: US 11,859,827 B1
(45) Date of Patent: Jan. 2, 2024

(54) HEAT DEFLECTOR SYSTEM

(71) Applicant: Mark Paul Redlinski, Glendale, AZ (US)

(72) Inventor: Mark Paul Redlinski, Glendale, AZ (US)

( * ) Notice: Subject to any disclaimer, the term of this patent is extended or adjusted under 35 U.S.C. 154(b) by 287 days.

(21) Appl. No.: 17/114,191

(22) Filed: Dec. 7, 2020

(51) Int. Cl.

| | |
|---|---|
| ***F24B 1/195*** | (2006.01) |
| ***F24B 3/00*** | (2006.01) |
| *F24B 1/192* | (2006.01) |
| *F24B 1/18* | (2006.01) |
| *F24B 1/191* | (2006.01) |

(52) U.S. Cl.
CPC ..... *F24B 1/1957* (2013.01); *F24B 3/00* (2013.01); *F24B 1/18* (2013.01); *F24B 1/191* (2013.01); *F24B 1/192* (2013.01); *F24B 1/195* (2013.01); *F24B 1/1955* (2013.01)

(58) Field of Classification Search
CPC .. F24B 1/1957; F24B 3/00; F24B 1/18; F24B 1/191; F24B 1/192; F24B 1/195; F24B 1/1955
USPC ..... 126/9 B
See application file for complete search history.

(56) References Cited

U.S. PATENT DOCUMENTS

| | | | | |
|---|---|---|---|---|
| 6,439,225 | B2 * | 8/2002 | Bach | A47J 37/0763 126/50 |
| 2012/0318255 | A1 * | 12/2012 | Brown | F23B 20/00 126/25 R |
| 2019/0078790 | A1 * | 3/2019 | Kodila | F24B 1/195 |

OTHER PUBLICATIONS

Heat Warden USA (Made in America, Not China) Heat Deflector to Push Heat Down and Out to Warm Friends and Family. Also Protects Your Gazebo or Patio roof from Direct Heat from Amazon.com. First sale date is Jul. 2018. https://www.amazon.com/Heat-Warden-Deflector-Friends-Family/dp/B07LC7L3FN/ref=sr_1_2?dchild=1&keywords=Heat+Warden&qid=1607026087&sr=8-2.

* cited by examiner

*Primary Examiner* — Steven B McAllister
*Assistant Examiner* — Benjamin W Johnson
(74) *Attorney, Agent, or Firm* — IPTechLaw

(57) ABSTRACT

A heat deflector assembly comprising a hood and at least one support leg for supporting the hood above a fire pit, includes at least one side shield which is attachable to the hood, and configured to cover an open side formed between the fire pit and said hood, for capturing and directing heat generated by a fire lit in the fire pit.

15 Claims, 5 Drawing Sheets

HEAT DEFLECTOR SYSTEM

BACKGROUND

The embodiments herein relate generally to devices and methods for fire pits, including gas fire pits.

Persons sitting around a fire pit may often desire to keep warm as they enjoy the fire. However, heat generated by the fire pit may escape in an undirected matter, e.g. straight up and away from the user. As such, an improved fire pit system is desirable.

SUMMARY

According to various embodiments, disclosed is a fire pit system comprising a heat director device, which enables better retention of heat and/or redirection heat generated by the fire.

In embodiments, the disclosed system may comprise a fire pit device which may comprise a heat deflector/reflector hood, configured to capture heat generated by the fire and/or redirect the heat. The hood may comprise a generally planar sheet, and may further include downwardly angled edges. In embodiments, the hood may be a steel hood. In further embodiments, the device may comprise support leg(s) attached to the hood, and configured to support the hood over a fire pit. In further embodiments, the leg(s) may be foldable, i.e. collapsible, enable the device to be stored and/or used to cover the fire pit when not in use. In some embodiments, the system may comprise at least one side shield which may be attached to the hood, for directing the flow of captured heat. In further embodiments, the side shield may be removable and re-attachable. In yet further embodiments, the device may comprise a plurality of removable/re-attachable side shields, allowing a user to more effectively control the direction of heat flow via the number and/or positioning of the side shields. In some embodiments, the device may comprise a square hood, with four side shields that are each removable and re-attachable to the hood. In further embodiments, the device may comprise a handle coupled to the hood.

Thus, the disclosed system enables heat generated by the fire pit to be captured rather than escape upwards. In embodiments, the device may deflect heat downwards and outwards, via the stainless steel hood and/or side shields. This may enable users to better utilize the heat generated by the fire, and/or to keep warmer while sitting around the fire. Additionally, the ability to add the side shields as needed may enable the user to more effectively control the heat redirection. The collapsible legs enable easy storage and/or use of the device as a fire pit cover.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

With reference to the accompanying figures, disclosed is a fire pit device 10 comprising a heat deflector assembly 12 configured to capture and/or redirect heat generated by a fire.

In embodiments, the heat deflector assembly 12 may comprise a hood 12*a*, and legs 12*c* configured to support the hood 12*a* over a fire pit 14. In embodiments, the hood 12*a* may comprise angled edges 12*b*. In some further embodiments, the assembly 12 may comprise side shields 20 configured to attach to the hood 12*a*. In yet further embodiments, the legs 12*c* may be collapsible. In some embodiments, the assembly 12 may further include a handle 12*d*.

Figure 1:
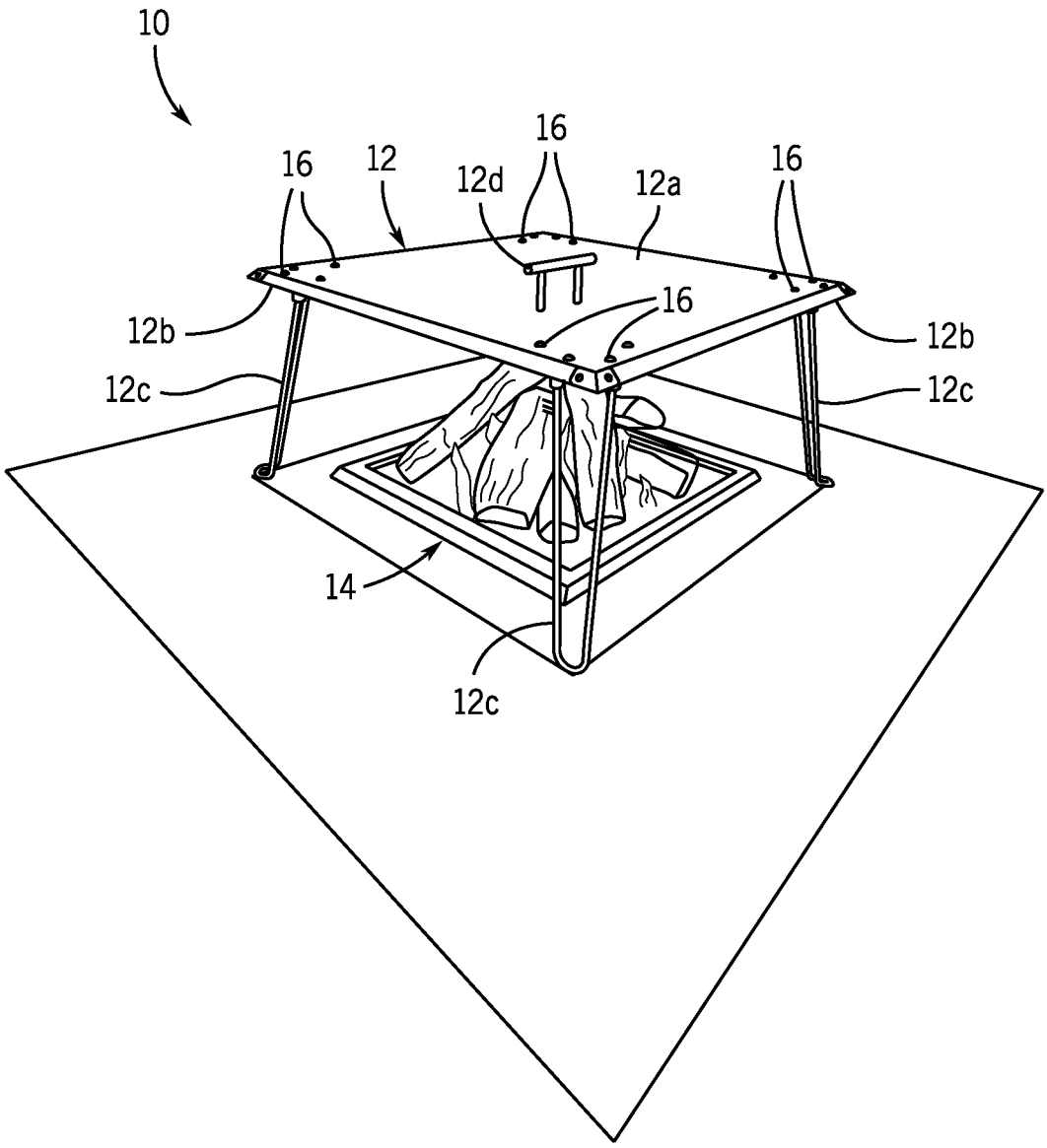
FIG. 1 is a perspective view of a fire pit device, according to various embodiments, shown placed over a fire pit.
Figure 2:
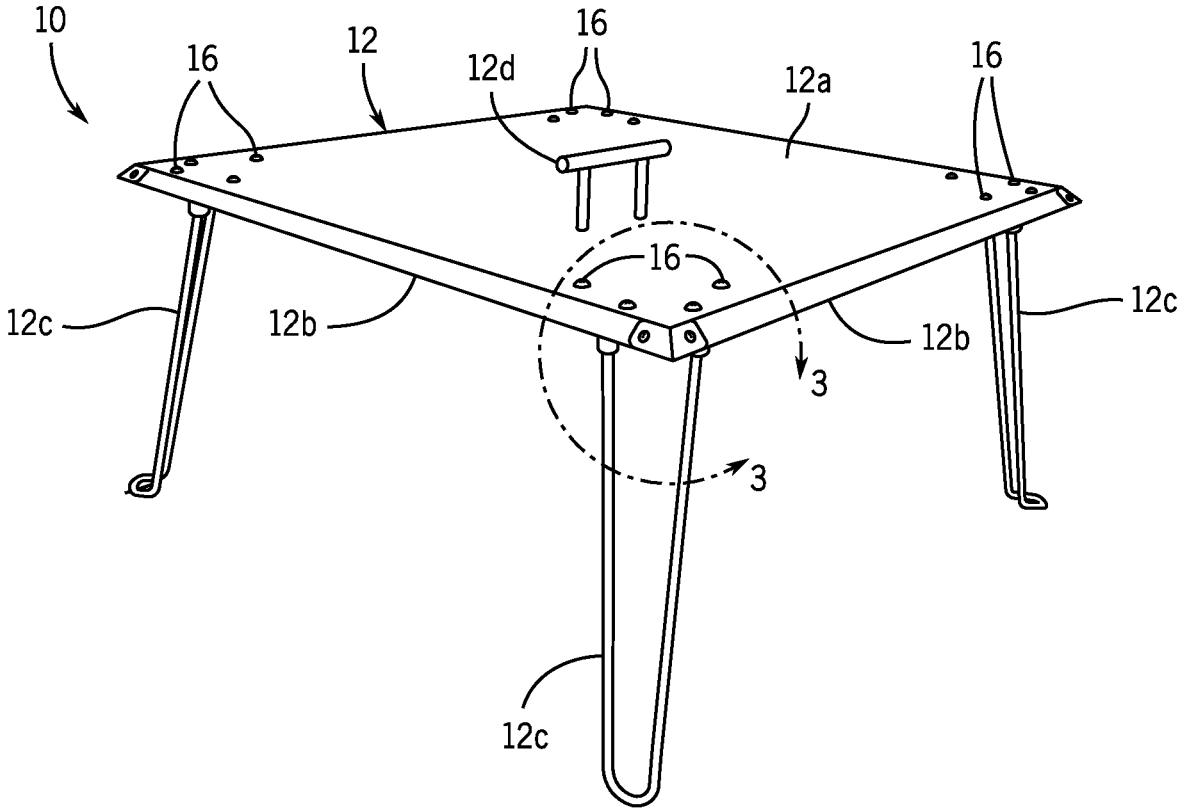
FIG. 2 is a perspective view of the fire pit device.
Figure 3:
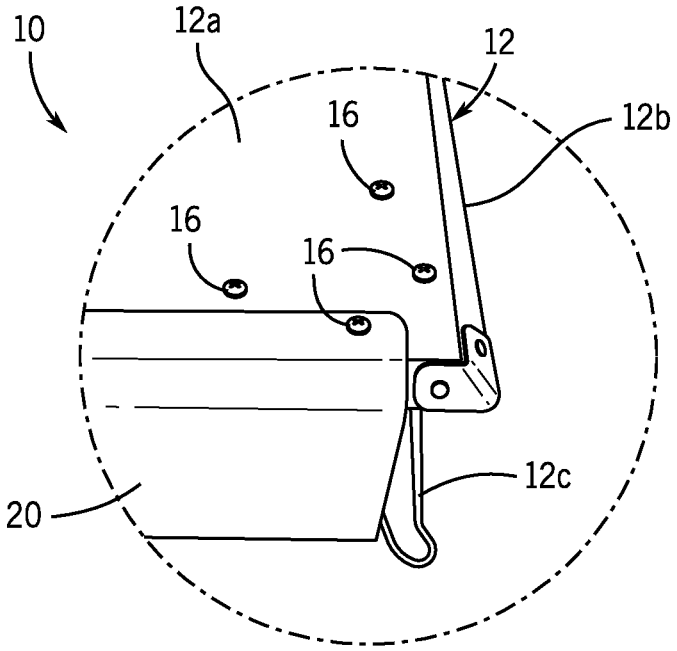
FIG. 3 is a detail perspective view taken from line 3-3 of FIG. 2.

As best shown in FIGS. 1 and 2, hood 12*a* may comprise a planar or generally flat sheet which may include downwardly and outwardly extending edges 12*b*. In embodiments, edges 12*b* may facilitate the downwards directing of heat. The edges 12*b* may extend a short distance downwards from a top flat surface of the hood 12*a*, and may be obtusely angled with respect to hood 12*a*. In embodiments, edges 12*b* may extend between about 1/2 of an inch to about 2 inches, or from about 3/4 of an inch to about 1.5 inches, or about 1 inch. Additionally, the angle between edges 12*b* and the top surface of hood 12*a* may generally be between 90 degrees and less than 180 degrees, or between about 110 degrees and about 160 degrees, or at about 135 degrees. In some embodiments, edges 12*b* may be formed by cutting a short segment at each corner of the hood sheet steel, and folding the segments between the cuts downwards (e.g. at 45 degrees) to create edges 12*b*. In some embodiments, protective corner coverings, as shown in FIG. 3, may be added to cover the corner openings between adjacent edges 12*b*.

Legs 12*c* may be coupled at a bottom surface of the hood 12*a*, for supporting the hood above a ground level. According to various embodiments, legs 12*c* may be between about 6 inches and 24 inches, or between about 10 inches and 20 inches, or at about 13 inches in height.

Figure 4:
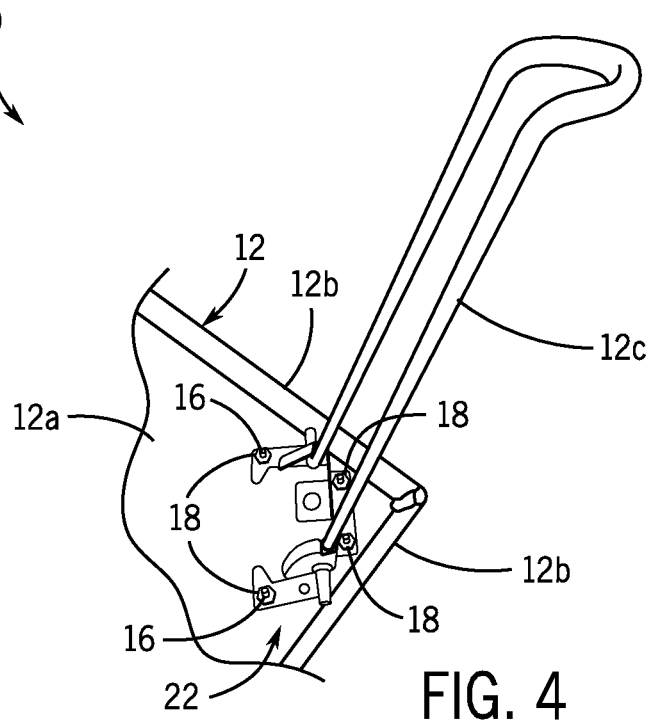
FIG. 4 is a detail perspective view of a collapsible leg of the fire pit device.
Figure 5:
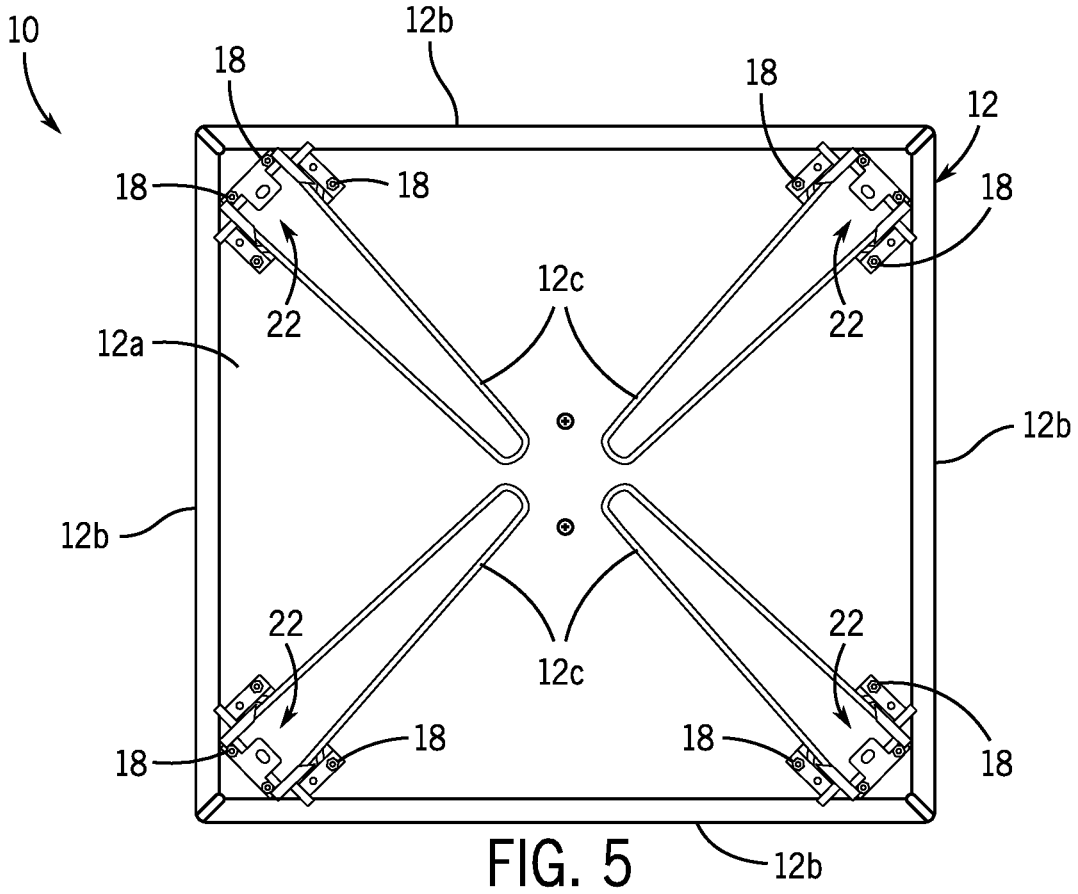
FIG. 5 is a bottom plan view of the fire pit device, shown in a collapsed state.

In embodiments, legs 12*c* may be foldable, such that the device 10 may be collapsed for easy storage, and/or placement over the fire pit 14 as a cover, when the fire pit 14 is not in use. With particular reference to FIGS. 4 and 5, and in accordance with an exemplary embodiment, each leg 12*c* may be pivotally coupled to the bottom surface of hood 12*a* via a leg hinge bracket 22. Each hinge bracket 22 may be secured to the hood 12*a* via leg attachment screws 16, engaged through corresponding screw holes in hinge bracket 22 and hood 12*a*, and secured with nuts and washers 18. In some embodiments, each leg 12*c*/leg hinge bracket 22 may be secured via 4 screws, wherein 2 of the screws may be removed and re-engaged to further secure a side shield 20, as detailed below.

In further embodiments, handle 12*d* may be coupled to a top surface of hood 12*a*, e.g. via screws and nuts. The handle 12*d* may facilitate a user in positioning the device 10 over the fire pit 14, and/or carrying the device.

According to an exemplary embodiment, hood 12*a* may have a square configuration, wherein four legs 12*c* may each be attached at around each corner of hood 12*a*, in order to support the hood over fire pit 14. However, other geometric configurations of the hood and support legs may be employed without departing from the inventive concept. For example, the hood 12*a* may be circular, rectangular, hexagonal etc., and comprise any number of legs necessary for its support. In some embodiments, the legs may be height adjustable (e.g. telescoping legs). In some embodiments, the geometric configuration and size of the hood may be designed to conform to the geometric configuration and size of the fire pit.

Figure 6:
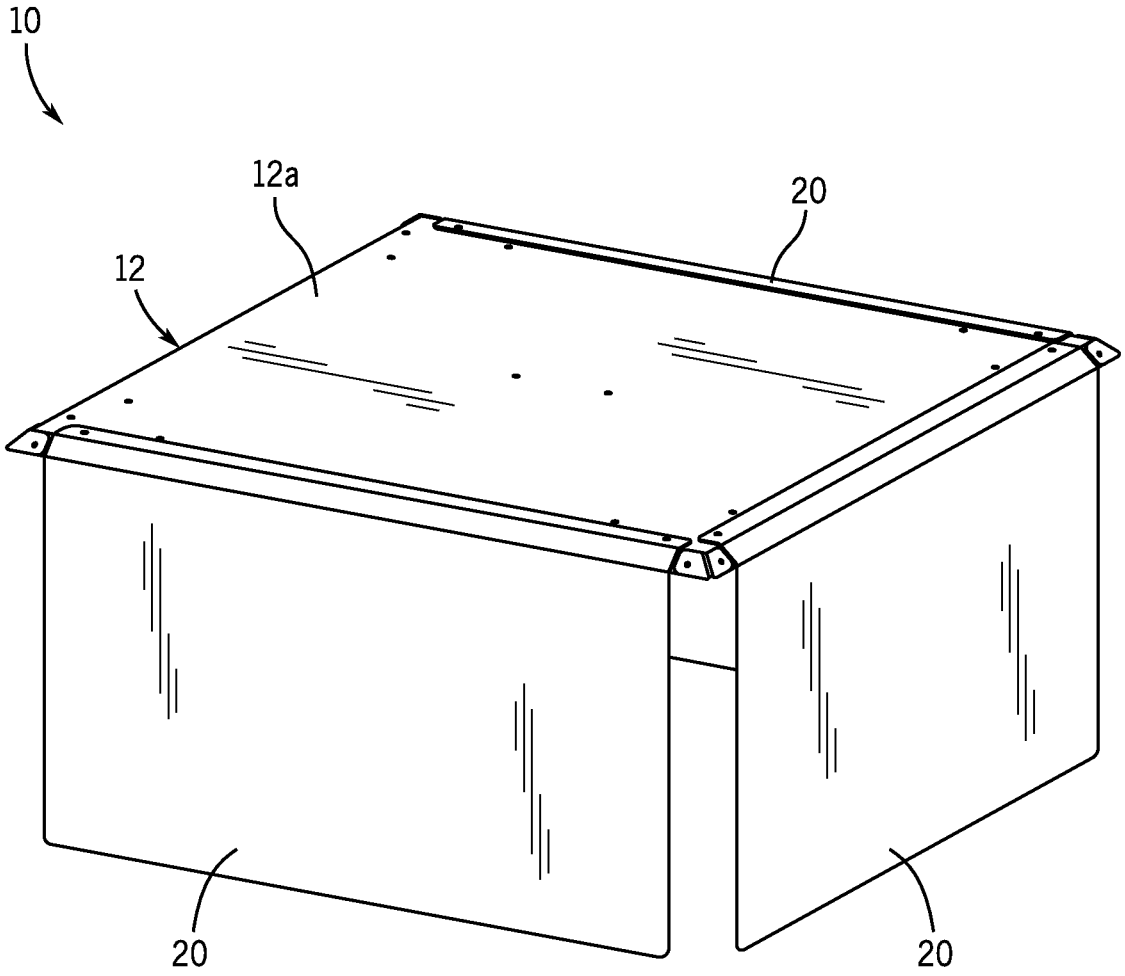
FIG. 6 is a perspective view of the fire pit device with shield attachments.
Figure 7:
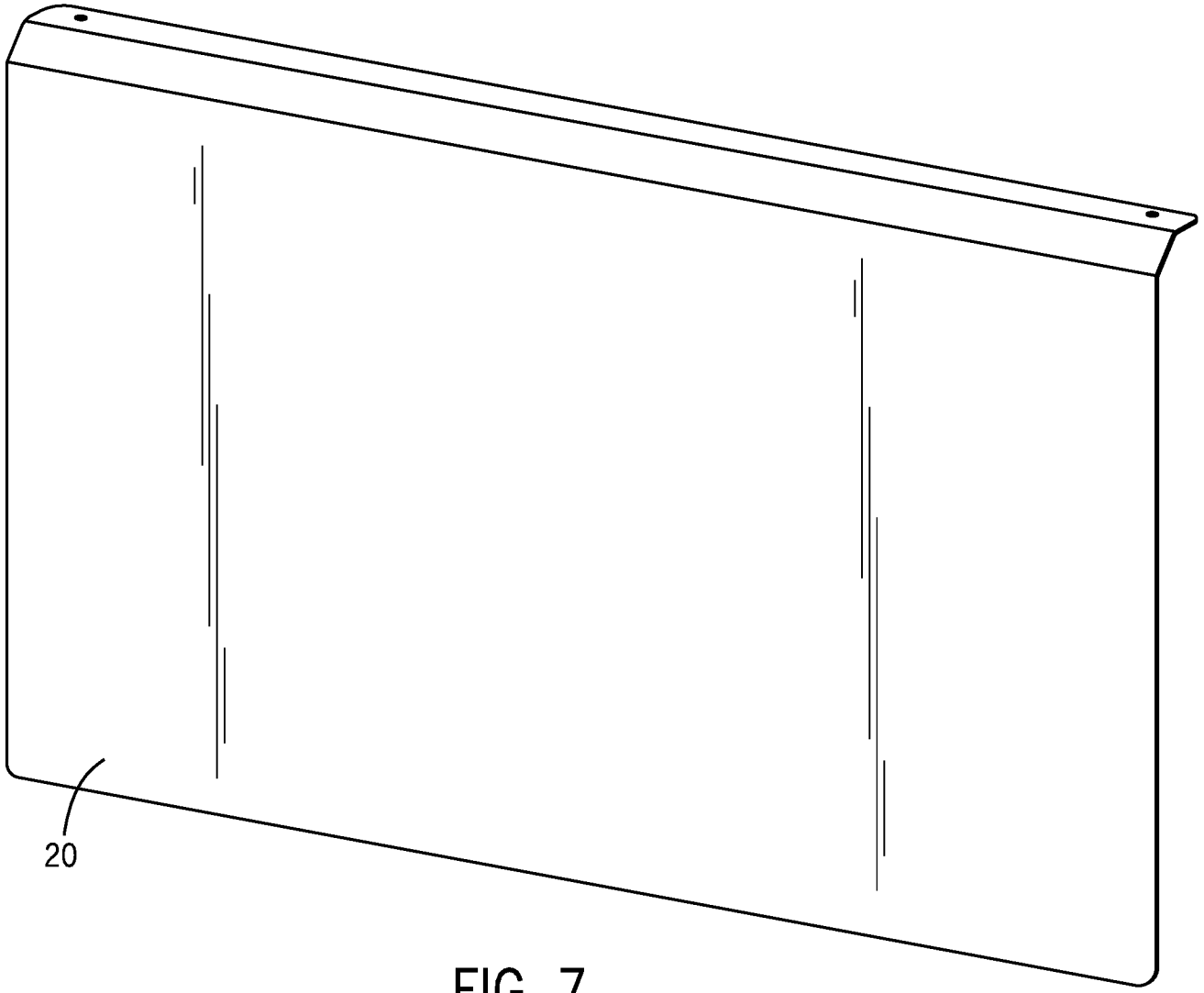
FIG. 7 is a perspective view of one of the shield attachments of the fire pit device.

With particular reference to FIGS. 3, 6, and 7 side shields 20 may be attached to hood 12*a* to cover side openings of device 10. In embodiments, side shields 20 may each be individually attachable and detachable from the hood 12*a*, which may allow the user to control the direction and/or concentration of heat based on the number and location of the attached side shields 20.

In embodiments, each side shield 20 may comprise a generally flat sheet with a top bend, wherein the top bend may be configured to overlap edges 12*b* of hood 12*a* when attached to the hood. In embodiments, each shield may be sized to substantially cover an area encompassed by the leg 12*c* and edge 12*b*, such that each side shield may substantially cover an open side of device 10 (see FIG. 6). According to an exemplary embodiment, assembly 12 including square hood 12*a* may include up to three side shields, enabling the user to add one, two, or up to three shields 20 to hood 12*a* (such that at least one side is left uncovered), whereby heat may be directed out from the uncovered side(s). However, it should be understood that other configurations may be employed without departing from the inventive concept. For example, each shield may be configured to cover half the edge 12*b*, wherein a user may optionally attach either one or two shields to cover either half or the entire open area of the hood.

In embodiments, the top bend of each side shield 20 may be attached via screws or other fastening elements. According to an exemplary embodiment, the top bend of shield 20 may include two screw holes (see FIG. 7), which may be configured to align with corresponding screw holes for legs 12*c*/leg hinge brackets 22. Thus, shield 20 may be attached to hood 12*a* by removing two of the leg attachment screws 16 and nuts/washers 18 on opposite corners of hood 12*a*. The shield 20 may then be placed against the hood 12*a* with the top bend of the shield 20 overlapping the top surface and edge 12*b* of hood 12*a*, such that screw holes of the shied are aligned with the open screw holes of the hood 12*a*. Then, the removed leg attachment screws 16 and nuts 18 and washers may be reinstalled to secure shield 20 to assembly 12 (see FIGS. 3 and 6).

In this manner, side shield(s) 20 may function to concentrate and direct heat generated by the fire. The user may determine how many shields to attach depending on the desired amount of heat concentration and/or direction. For example, one, two, or up to three side shields 20 may be attached to a fire pit device 10 having a square or rectangular configuration, wherein heat may be directed out from the uncovered side(s).

According to an exemplary embodiment, device 10 may be manufactured from all steel components. A piece of 304 stainless steel with an 18 gauge may be cut to the desired size and shape, which may be a square, to form hood 12*a* of assembly 12. Four holes may be cut on each corner to accommodate the screws, washers, and nuts which secure collapsible legs 12*c*/hinge brackets 22, and side shields 20. Two holes may be drilled into the center of the steel hood to accommodate the screws for securing steel handle 12*d*. Lastly two rivet holes may be drilled in each corner to accommodate rivets for securing steel protective corners, which may be added for support. The corners of the square sheet may then be cut approximately 1 inch deep, and the 1 inch segments between the cuts may be bent downward to a 45 degree angle to form the four corner edges 12*b*. The supportive steel corners may then be riveted to the steel hood at the corners. The collapsible steel legs (legs 12*c* and hinge bracket 22 assembly) may then secured underneath the steel hood at each corner. The steel handle may be added at the center of the hood.

In embodiments, the steel legs 12*c* may be approximately 13 inches, such that when the legs are extended, the steel hood sits 13 inches above the fire pit opening. The 13 inch height and downwardly extending edges may force heat downward and outward while still allowing users to enjoy the fire, and even toast food (e.g. marshmallows, hot dogs, etc.).

The side shields may be added as desired to the steel hood via the same holes with the screws, nuts, and washers used for securing the steel legs. The Side Shields can be attached to the steel hood on 1, 2, or 3 sides to block wind and control the direction of the fire pit heat. The heat may also be more concentrated as more side shields are attached according to the user's preference. Thus, the device may be placed over the fire pit (with the fire first lit). If the side shields are being used, the opening without the side shields may face the users for providing heat.

It shall be appreciated that other mechanical fasteners or fastening mechanisms can be used in alternative embodiments to secure the assembly components. Additionally, the components of the disclosed system can be made from any suitable materials including, but not limited to, various metals, stone, or other fire resistant materials which are or may become available with emerging technology. It shall be appreciated that the components of the assembly described herein may comprise any alternative known materials in the field and be of any color, size and/or dimensions. It shall be appreciated that the components of the device described herein may be manufactured and assembled using any known techniques in the field.

Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A fire pit device comprising:

a heat deflector assembly comprising:

a hood comprising a top flat surface and four side edges extending downwards and outwards from the top flat surface;

four support legs coupled to a bottom side of the hood and configured to support the hood above a fire pit such that the hood covers a top side of the fire pit; and a side shield removably attachable to the hood, the side shield comprising a top bend portion coupled to a lower sheet portion;

wherein each of the four support legs is coupled to a bottom side of the hood through a hinge bracket directly coupled to the bottom side of the hood, the bottom side of the hood configured to face the fire pit when the hood covers the top side of the fire pit;

wherein each of the four support legs are configured to fold towards the bottom side of the hood and lie substantially parallel to the bottom side of the hood when in a folded orientation;

wherein an entire width of the top bend portion is configured to cover, and lie parallel to the top flat surface and one of the four side edges;

wherein the side shield is configured to removably couple to the hood over any of the four side edges; and wherein the heat deflector assembly is configured to capture and direct heat generated by a fire lit in the fire pit.

2. The fire pit device of claim 1, wherein each of the four side edges extends between about 1/2 of an inch to about 2 inches downwards and outwards from the top flat surface.

3. The fire pit device of claim 2, wherein the lower sheet portion of the side shield drapes down from the hood to cover an open side formed between the fire pit and the hood, wherein a width of the lower sheet portion is equal to the entire width of the top bend portion.

4. The fire pit device of claim 1, wherein each of the four support legs are configured to fold towards a same center point on the bottom side of the hood.

5. The fire pit device of claim 1, further comprising a second side shield and a third side shield, wherein the second side shield and the third side shield include identical structures to the side shield.

6. The fire pit device of claim 1, wherein the hood includes a handle.

7. A heat deflection kit comprising:

a hood comprising a top flat surface and four side edges extending downwards and outwards from the top flat surface;

four support legs coupled to a bottom side of the hood and configured to support the hood above a fire pit such that the hood covers a top side of the fire pit;

a first side shield removably attachable over the top flat surface of the hood;

a second side shield removably attachable over the top flat surface of the hood; and a third side shield removably attachable over the top flat surface of the hood, each of the first side shield, the second side shield, and the third side shield comprising a top bend portion coupled to a lower sheet portion;

wherein each of the four support legs is coupled to a bottom side of the hood through a hinge bracket directly coupled to the bottom side of the hood, the bottom side of the hood configured to face the fire pit when the hood covers the top side of the fire pit;

wherein each of the four support legs are configured to fold towards the bottom side of the hood and lie substantially parallel to the bottom side of the hood when in a folded orientation;

wherein an entire width of the top bend portion of each of the first side shield, second side shield, and third side shield is configured to couple over and lie parallel to the top flat surface and one of the four side edges;

wherein each of the first side shield, second side shield, and third side shield are configured to removably couple to the hood over any of the four side edges; and wherein the heat deflection kit is configured to capture and direct heat generated by a fire lit in the fire pit out of an open side of the heat deflection kit.

8. The kit of claim 7, wherein the kit does not include more than three side shields.

9. The kit of claim 7, wherein each of the first side shield, second side shield, and third side shield are identical.

10. The kit of claim 7, wherein the heat deflection kit is configured to comprise a first gap between the first side shield and the second side shield and a second gap between the second side shield and the third side shield when the first side shield, second side shield, and third side shield are coupled over the top flat surface.

11. A heat deflector comprising:

a hood comprising a top flat surface and four side edges angled away from the top flat surface;

four support legs coupled to a bottom side of the hood and configured to support the hood above a fire pit such that the hood covers a top side of the fire pit;

a first side shield removably attachable over the top flat surface of the hood and configured to cover a first side of the heat deflector;

a second side shield removably attachable over the top flat surface of the hood and configured to cover a second side of the heat deflector; and a third side shield removably attachable over the top flat surface of the hood and configured to cover a third side of the heat deflector, each of the first side shield, the second side shield, and the third side shield comprising a top bend portion coupled to a lower sheet portion;

wherein an entire width of the top bend portion of each of the first side shield, second side shield, and third side shield is configured to couple over and lie parallel to the top flat surface and one of the four side edges;

wherein each of the first side shield, second side shield, and third side shield are configured to removably couple to the hood over any of the four side edges; and wherein the heat deflector is configured to capture and direct heat generated by a fire lit in the fire pit out of an open side of the heat deflector.

12. The heat deflector of claim 11, wherein each of the four support legs are configured to fold towards a same center point on the bottom side of the hood.

13. The heat deflector of claim 11, wherein the heat deflector is configured to operate with none of the first side shield, second side shield, and third side shield, with only a single side shield, with only two side shields, and with three side shields.

14. The heat deflector of claim 11, wherein the-each side shield comprises openings corresponding to openings within the flat top surface that allow each side shield to be coupled to the top flat surface.

15. The heat deflector of claim 11, wherein the heat deflector comprises no more than three side shields.

* * * * *